US006384533B1

(12) United States Patent
Giesel et al.

(10) Patent No.: US 6,384,533 B1
(45) Date of Patent: May 7, 2002

(54) METAL COMPONENT AND DISCHARGE LAMP

(75) Inventors: Thomas Giesel, Erlensee; David Francis Lupton, Gelnhausen; Frank Krüger, Wölfersheim; Friedhold Schölz, Rodenbach, all of (DE)

(73) Assignee: W. C. Heraeus GmbH & Co. KG, Hanau (DE)

( * ) Notice: Subject to any disclaimer, the term of this patent is extended or adjusted under 35 U.S.C. 154(b) by 0 days.

(21) Appl. No.: 09/506,063

(22) Filed: Feb. 17, 2000

(30) Foreign Application Priority Data

Apr. 9, 1999 (DE) ..... 199 15 920

(51) Int. Cl.[7] ..... H01J 61/30
(52) U.S. Cl. ..... 313/623; 313/624; 313/625
(58) Field of Search ..... 313/623, 624, 313/625, 634, 331

(56) References Cited

U.S. PATENT DOCUMENTS

| | | | | |
|---|---|---|---|---|
| 4,015,165 A | | 3/1977 | Hardies | |
| 5,336,968 A | * | 8/1994 | Strok et al. | 313/571 |
| 5,424,609 A | * | 6/1995 | Geven et al. | 313/623 |
| 6,271,627 B1 | * | 8/2001 | Morimoto et al. | 313/623 |

FOREIGN PATENT DOCUMENTS

| | | |
|---|---|---|
| DE | 626363 | 2/1936 |
| DE | 1052580 | 9/1955 |
| DE | 963173 | 5/1957 |
| DE | 2602308 | 8/1976 |
| DE | 2641867 | 4/1977 |
| DE | 8628310 | 8/1989 |
| EP | 0341750 | 11/1989 |
| EP | 0410511 | 1/1991 |
| EP | 0751549 | 1/1997 |
| EP | 0930639 | 7/1999 |
| GB | 2178230 | 2/1987 |
| WO | 9837570 | 8/1998 |

* cited by examiner

*Primary Examiner*—Vip Patel
*Assistant Examiner*—Ken A Berck
(74) *Attorney, Agent, or Firm*—Fulbright & Jaworski, L.L.P.

(57) ABSTRACT

The invention relates to a metal component for discharge lamps, having a support of niobium or tantalum or of alloys based on niobium and/or tantalum, as well as a discharge lamp. The present invention is addressed to the problem of increasing the resistance to oxidation and corrosion of metal components having a support of niobium or tantalum or of alloys based on niobium and/or tantalum which are disposed in or on discharge lamps. The problem is solved according to the invention in that the support has a coating of one or more single layers which is formed of at least one noble metal and/or from a noble metal alloy.

4 Claims, 1 Drawing Sheet

METAL COMPONENT AND DISCHARGE LAMP

BACKGROUND AND SUMMARY OF THE INVENTION

The invention relates to a metal component for discharge lamps, having a support of niobium or tantalum or of alloys based on niobium and/or tantalum, and to a discharge lamp.

Such a component is disclosed in G 86 28 310.3. It shows a possibility of using niobium as a power lead-through for high-pressure lamps. A gas-tight fusion embedding and a very complex method of construction is used in order to protect the niobium against corrosion by, for one thing, aggressive metal halides.

In GB 2 178 230 A such components are used as connection pins for a discharge lamp. It is recommended that such a discharge lamp be used in a temperature range of 200–300° C. and in an atmosphere of high moisture content, in conjunction with an external capsule which protects the connection pins against oxidation and corrosion. An example shows the discharge lamp and the connection pins within a sealed and gas-tight protective glass capsule filled with noble gas.

The problem of the extremely low resistance of niobium and its alloys to oxidation even at low temperatures from about 400° C. is described in the publication, "Niobium in High Temperature Applications" by the author H. Inouye, which is based on a symposium held on Nov. 8, 1981 in San Francisco (Proceedings of the International Symposium). The metal tantalum, which is closely related to niobium, behaves in a similar manner. On account of this property the use of these metals and their alloys at elevated temperatures is severely limited. Thus, coatings are known which increase oxidation resistance. These are usually silicide or aluminide coatings which can be applied only with great difficulty. Also, the brittleness of these coatings impairs resistance to thermal shock, combined with the cracking and spalling off of the coating. The intended protection of the coating is thereby lost and the oxidation of the metal can spread from the flaws in the coating.

The present invention is addressed to the problem of improving the resistance to oxidation and corrosion of metal components with a support of niobium or tantalum or of alloys based on niobium and/or tantalum, which are employed in or on discharge lamps.

The problem is solved according to the invention by giving the support a coating of one or more individual layers, which is formed of at least one noble metal and/or a noble metal alloy. Such a coating very well satisfies the need for increasing oxidation and corrosion resistance and providing sufficient ductility and thermal shock resistance.

Ideally, the noble metals gold and/or platinum and/or palladium and/or an alloy formed of at least two of these elements is used for the coating built up of one or more individual layers. These noble metals used for the coating have a melting point above 1000° C. In a reducing or inert atmosphere, these coatings therefore permit exposure to higher temperatures than the temperatures normally occurring in the discharge lamp, so that any mounting processes needed before use, such as soldering, can be carried out. For example, connection wires of niobium alloys for discharge lamps can first be coated with the noble metal, and then the coated connection wires can be soldered into openings in the discharge vessel without losing the protective effect of the coating due to the heat stress produced by the soldering process.

It has proven to be especially advantageous if a first single layer of gold is applied to the support, and then a second single layer of platinum and/or palladium and/or of an alloy that is formed of at least two of the noble metals gold, platinum or palladium.

A first single layer has preferably a thickness of 0.1 $\mu$m, and additional single layers applied thereon a thickness of 1 $\mu$m to 5 $\mu$m. The term, "single layer," is to be understood to mean a layer of a noble metal or of a noble metal alloy, which is applied in one step or in successive steps, also by means of different application methods.

In view of the temperature range prevailing during use, the coating material is to be selected from among the said noble metals or noble metal alloys according to their melting point. If different noble metals are combined, diffusion compounds can form due to the action of elevated temperatures. The coating can thus have a noble metal mixed crystal produced by diffusion, which is present either only at the interface between two single coatings or else may take up the entire volume of the coating. For example, in the case of gold as the first single layer and palladium as second single layer, if the palladium diffuses into the gold layer under it, its melting point increases. This diffusion compound can be produced by a temperature treatment, for example directly after the production of the coated component, during a soldering process in the mounting of the component or else at the point of use and under the conditions of use.

The single layer can be applied physically and/or chemically to the support of niobium or tantalum or of alloys based on niobium and/or tantalum. Ideally, the application of a single layer is performed by sputtering and/or electroplating, since in this case a selective coating of surfaces of components of complex shape is also possible. Also, both methods are simple and uncomplicated, and can be performed without the use of high temperatures. Above all the first single layer is produced preferably by sputtering or by sputtering followed by an electroplating process, since the sputtered noble metal enters into a firmly adherent bond with the support and thus acts as an adhesion-mediating agent.

The surface quality of the support of niobium and tantalum or of alloys based on niobium and/or tantalum has a decided influence on the duration of the protective effect of the coating. If many flaws, such as pores, scratches or traces of machining are on the surface of the support, the probability increases that the coating will not be fully continuous at these places. At such flaws, which may propagate in the coating in the form of holes or thin areas, for example, the support may be attacked by oxidation or corrosion. If the support is made of niobium or tantalum or of alloys based on niobium or tantalum it has proven to be advantageous for good adhesion to chemically clean and activate the surface before applying the coating. For example, an etching of the parts is possible, which removes chiefly inorganic deposits, including oxide coatings.

The discharge lamp according to the invention contains a discharge vessel through whose wall metal components are passed as power connections, as in the case, for example, of high-pressure lamps. The power connections have a support of niobium or tantalum or alloys based on niobium and/or tantalum, which has a coating of one or more single layers which are formed of at least one noble metal and/or of a noble metal alloy. A great advantage of discharge lamps with power connections coated in this manner is that they can be operated without any additional external encapsulation, of glass, for example. The noble metal used with preference for coating the power connections is gold and/or platinum and/or palladium and or an alloy formed from at least two of these noble metals.

It has proven especially advantageous if a first single layer of gold is applied to the support of the power connections, and thereon a second single layer of platinum and/or palladium and/or an alloy which is formed from at least two of the noble metals gold, platinum or palladium. The first single layer can have a thickness of 0.1 μm to 5 μm, and additional single layers applied thereon a thickness of 1 μm to 5 μm each. The coating can cover the support of the power connections also just partially. Also, the coating can have a noble metal mixed crystal produced by diffusion.

The following examples 1 to 9 and the figure set forth the advantage of the invention in detail. For all examples, components in the form of wire pins of the alloy NbZr1 with the diameter of 1 mm and a length of 15 mm.

BRIEF DESCRIPTION OF THE FIGURE

The FIGURE is a preferred embodiment of the discharge lamp of the present invention.

DETAILED DESCRIPTION

EXAMPLE 1 (Example for Comparison)

Figure 1:
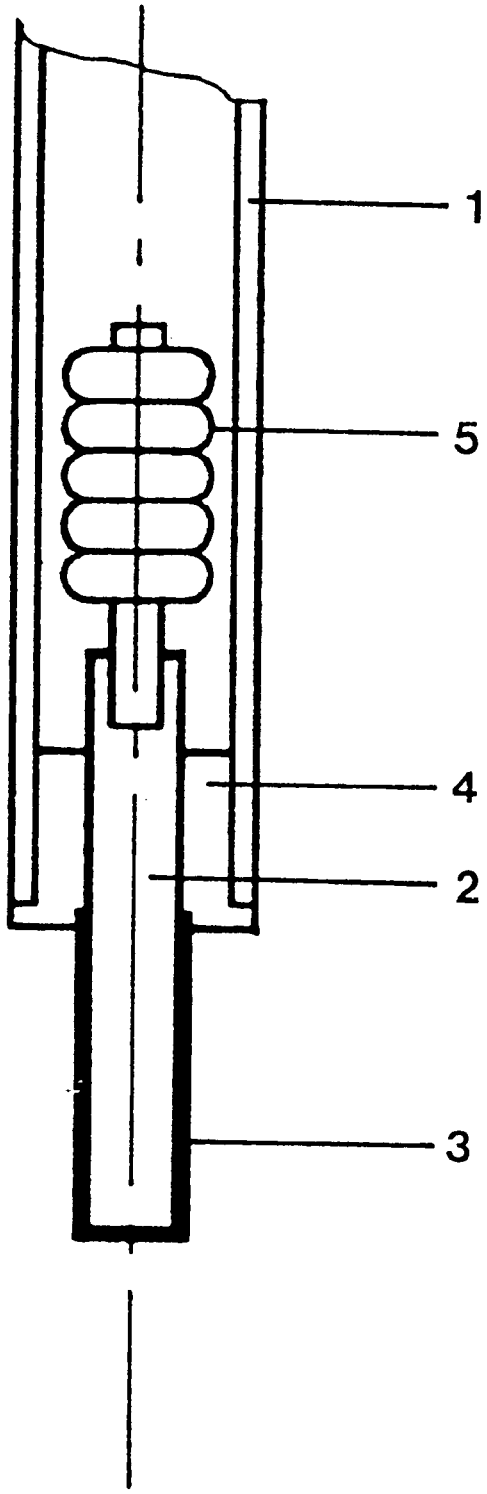

Experiment: Wire pins were treated in air at a temperature of 500° C. for a period of 10 h.

Result: The wire pins degraded to a white dust of niobium-zirconium oxide.

EXAMPLE 2

Preliminary treatment: Wire pins were cleaned by etching in a mixture of dilute sulfuric acid and hydrofluoric acid. Gold was sputtered onto the etched surfaces of the wire pins, in a thickness of about 0.2 μm and here serves as an adhesion-mediating agent. The sputtered gold was coated by means of a commercial, alkaline bath with galvanically deposited fine gold about 4 μm thick.

Test: The wire pins with a single layer of gold accordingly about 4.2 μm thick applied by sputtering and galvanic deposition were treated in air for a period of 10 h at a temperature of 500° C.

Result: No indication of oxidative attack on the gold-coated wire pins was found.

EXAMPLE 3

Preliminary treatment: same as in Example 2.

Test: Wire pins with a single coating accordingly. about 4.2 μm thick of gold applied by sputtering and galvanic deposition were treated in air for 5 min at a temperature of 900° C.

Result: No indication of oxidative attack on the gold-coated wire pins was found.

EXAMPLE 4

Preliminary treatment: same as in Example 2.

Test: Wire pins with a single coating accordingly about 4.2 μm thick of gold applied by sputtering and galvanic deposition were treated in air for 5 min at a temperature of 900° C. and then treated for a period of 10 h at a temperature of 500° C.

Result: A very slight oxidative attack on the gold-coated wire pins was found. A metallographic microsection showed that a diffusion compound had developed between the NbZr1 alloy and the gold coating.

EXAMPLE 5

Preliminary treatment: same as in Example 2.

Test: Wire pins with a single coating accordingly about 4.2 μm thick of gold applied by sputtering and galvanic deposition were treated in air for 5 min at a temperature of 1100° C.

Result: Since the temperature of 1100° C. used in the test was above the melting point of gold, signs of incipient fusion were observed in the gold coating. Nevertheless, no obvious oxidative attack on the gold coated wire pins was found.

EXAMPLE 6

Preliminary treatment: same as in Example 2.

Test: Wire pins with a single coating accordingly about 4.2 μm thick of gold applied by sputtering and galvanic deposition were exposed to air for 5 min at a temperature of 1100° C. and then treated for a period of 10 hours at a temperature of 500° C.

Result: signs of incipient fusion were observed in the coating and a very slight oxidative attack on the gold-coated wire pins.

EXAMPLE 7

Preliminary treatment: Wire pins were cleaned by etching in a mixture of dilute sulfuric acid and hydrofluoric acid. Gold was sputtered onto the etched surfaces of the wire pins in a thickness of about 0.2 μm, which here serves as an adhesion mediating agent. The sputtered gold was plated by means of a commercial alkaline bath with galvanically deposited fine gold about 4 μm thick. Then this single layer of gold with a total thickness of about 4.2 μm was plated galvanically in a neutral bath (pH 7.8) with a single layer of palladium about 3 μm thick.

Test: The wire pins with the two single layers of gold and palladium were treated in air for a period of 5 min at a temperature of 1100° C. and then for 10 h at a temperature of 500° C.

Result: Neither were incipient fusion signs found on the coating nor indications of oxidative attack on the wire pins coated with gold and palladium.

EXAMPLE 8

Preliminary treatment: as in Example 7.

Test: the wire pins with the two single coatings of gold and palladium were treated in air for a period of 10 h at a temperature of 500° C.

Result: No oxidative attack was observed on the wire pins coated with gold and palladium. A metallographic microsection showed that on some pins a complete gold-palladium mixed crystal had formed in the coating. The coating had formed an firmly adherent bond to the wire pins.

EXAMPLE 9

Preliminary treatment: Wire pins were cleaned by etching in a mixture of dilute sulfuric acid and hydrofluoric acid. Palladium was sputtered onto the etched surfaces of the wire pins in a thickness of about 0.4 μm, which here serves as an adhesion-mediating agent. The sputtered palladium was coated with galvanically deposited palladium about 4 μm thick by means of a neutral commercial bath.

Test: The wire pins with the accordingly 4.4 μm thick single layer of palladium, applied by sputtering and galvanic deposition, were treated in air for a period of 5 min. at a temperature of 1100° C. and then for 10 h at a temperature of 500° C.

Result: No oxidative attack was observed on the palladium-coated wire pins.

The figure shows for example one of the two connection areas of a discharge lamp. In this example the discharge lamp is made with a tubular discharge vessel of ceramic and a power connection 2 of niobium, whose surface is partially covered with the coating 3 of noble metal according to the invention. The power connection 2 is soldered gas-tight into the tubular opening of the discharge vessel 1 and extends with the uncoated end into the discharge vessel 1. The other end of the power connection 2 with the coating 3 is outside of the discharge vessel 1 in the ambient air. The glass solder 4 also covers the area of the power lead-through 2 at which the coating 3 ends, so that the power connection 2 is completely covered with the coating 3 in the area outside of the discharge vessel 1 and is protected against oxidation by the oxygen of the ambient air. The uncoated end of the power connection 2 here bears a tungsten electrode 5, for example.

What is claimed is:

1. A discharge lamp comprising a ceramic discharge vessel and metal components as connection pins, wherein said connection pins each have a first end extending into the discharge vessel and a second end extending out of the discharge vessel, said connection pins being soldered gas-tight into openings of the discharge vessel by a glass solder, wherein the connection pins, each have a support of at least one of niobium, tantalum or alloys thereof wherein said support has a coating of at least one layer which is formed from at least one noble metal of one noble metal alloy, wherein the coating covers the support at said second ends of said connection pins wherein the glass sealing partially covers the coating.

2. A discharge lamp according to claim 1, wherein the noble metal is at least one noble metal selected from the group consisting of gold, palladium, and an alloy formed of at least two of gold, platinum and palladium.

3. A discharge lamp according to claim 1, wherein a first single layer of gold is applied to the support, and thereon a second single layer comprising a member selected from the group consisting of platinum, palladium, gold and an alloy comprising at least two noble metals selected from the group consisting of gold, platinum and palladium.

4. A discharge lamp according to claim 1, wherein said coating contains a noble solid solution produced by thermal treatment of at least two single layers of different noble metals, noble metal alloys or a combination thereof.

* * * * *